US007634215B2

(12) United States Patent
Imamura et al.

(10) Patent No.: US 7,634,215 B2
(45) Date of Patent: Dec. 15, 2009

(54) DEVELOPING APPARATUS

(75) Inventors: Issei Imamura, Numazu (JP); Seiji Yamaguchi, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 135 days.

(21) Appl. No.: 11/953,150

(22) Filed: Dec. 10, 2007

(65) Prior Publication Data

US 2008/0138118 A1 Jun. 12, 2008

(30) Foreign Application Priority Data

Dec. 12, 2006 (JP) ..... 2006-334447

(51) Int. Cl.
*G03G 15/08* (2006.01)
*G03G 15/00* (2006.01)
*G03G 15/04* (2006.01)

(52) U.S. Cl. ..... 399/254; 399/255; 399/252; 399/258; 399/119; 399/110; 399/107

(58) Field of Classification Search ..... 399/254–256, 399/252, 258, 119, 120, 107, 110, 262, 263, 399/222
See application file for complete search history.

(56) References Cited

U.S. PATENT DOCUMENTS 5,682,585 A 10/1997 Yamaguchi et al.
5,781,835 A 7/1998 Okano et al.
5,963,766 A 10/1999 Okuno et al.
6,058,284 A 5/2000 Okano et al.
6,151,467 A 11/2000 Yamaguchi
6,281,961 B1 * 8/2001 Sako et al. ..... 355/27
6,324,369 B1 11/2001 Yamaguchi et al.
6,381,431 B1 4/2002 Kinoshita et al.
6,421,516 B1 7/2002 Kinoshita et al.
6,640,060 B2 10/2003 Yamaguchi et al.
7,006,774 B2 2/2006 Saito et al.
7,035,573 B2 4/2006 Yamaguchi et al.
7,050,733 B2 5/2006 Saito et al.
2005/0117920 A1 6/2005 Ogata et al.
2006/0045573 A1 * 3/2006 Yamaguchi et al. ..... 399/254
2006/0045574 A1 * 3/2006 Kawai et al. ..... 399/254

FOREIGN PATENT DOCUMENTS

JP 11-024382 1/1999

* cited by examiner

*Primary Examiner*—David M Gray
*Assistant Examiner*—Rodney Bonnette
(74) *Attorney, Agent, or Firm*—Fitzpatrick, Cella, Harper & Scinto

(57) ABSTRACT

A developing apparatus includes: an agitating chamber agitating a developer; a developing chamber provided with an inlet to which the developer is supplied from the agitating chamber and an outlet from which the developer is returned to the agitating chamber; a developer carrying member; a rotatable developer supplying member supplying the developer to the developer carrying member; a developer conveying member, provided above the center of rotation of the developer supplying member in the developing chamber, for conveying the developer in a longitudinal direction of the developer carrying member, wherein, in a vertical cross-sectional area of a region vertically above the center of rotation of the developer supplying member of the developing chamber, excluding a developer conveying region by the developer conveying member, a cross-sectional area S1 upstream in the developer conveying direction and a cross-sectional area S2 downstream in the developer conveying direction satisfy a relationship of S1<S2.

15 Claims, 14 Drawing Sheets

PRIOR ART

PRIOR ART

PRIOR ART

PRIOR ART

PRIOR ART

PRIOR ART

DEVELOPING APPARATUS

BACKGROUND OF THE INVENTION

1. Field of the Invention

The present invention relates to a developing apparatus that can be used for an image forming apparatus, such as a copying machine, a facsimile machine, a printer and a combined copying machine. The developing apparatus can be provided in a cartridge detachably mountable to the main body of the image forming apparatus.

2. Description of the Related Art

Conventionally, a developing system using dual-component developer has been frequently used in general, but in recent years, there has been a growth in the use of developing apparatuses using mono-component developer that are simple in construction and advantageous also in running cost. Also, there is available a replenishing system for replenishing a developer (hereinafter simply referred to as "toner") in order to maintain image quality satisfactory until it reaches the end of developer life. Even in this case, however, the use of the mono-component developer is being substituted for the dual-component developer. In addition, a developing apparatus with the aim of downsizing by adopting vertical circulation of toner is also proposed (refer to, for example, Japanese Patent Application Laid-Open No. H11-024382).

In the replenishing system of a developer, there are differences in physical properties such as charge amount and flowability between an existing toner that currently exists in a developing chamber and a new replenished toner that is replenished, and the existing toner and the replenished toner having different physical properties from each other coexist in one developing chamber. In this case, when physical properties of both the existing toner and the replenished toner are greatly different, so-called coarseness or fog on a white background portion may occur in a half-tone image, and there occur defects such as a dropping on sheet. To resolve such defects, there are many developing apparatuses with a construction to convey a toner while agitating adequately the replenished toner with the existing toner.

FIG. 9 and FIG. 10 illustrate one example of a developing apparatus of such a replenishing system and a toner circulation configuration. A developing apparatus 11 is comprised of two chambers, an agitating chamber 9 and a developing chamber 10. The agitating chamber 9 and the developing chamber 10 are separated from each other by a partition wall 16, and an inlet 19 and an outlet 20 are provided at both ends of the partition wall 16 and opened in the partition wall 16 so as to allow the toner to flow to and from. In the developing chamber 10, a developing roller 1, a toner supply roller 2, a toner regulating member 3 and a developing container 12 are accommodated therein. Also, a screw 4 is arranged in parallel with the toner supply roller 2, and the agitating chamber 9 is arranged at the opposite side of the screw 4 sandwiching the partition wall 16. The screw 4 is provided at a higher level in the gravitational direction than an axis of a rotation center of the toner supply roller 2, in order to carry out two functions of supplying the toner to the toner supply roller 2 and returning the toner to the agitating chamber 9.

A toner replenishing operation corresponding to the detection of the toner amount in the agitating chamber 9 as well as the obtained information regarding coverage rates of images is performed by a replenishing device 8, then the replenished toner is dropped off into the agitating chamber 9 after passing through an opening 6. An agitating member 5 arranged in the agitating chamber 9 can level the toner horizontally, but does not have further conveying capability. Accordingly, even if the agitating member 5 in the agitating chamber 9 attempts to rotate to the limit, there are no cases where it actively feeds the toner to the inlet 19. The movement of the toner in the agitating chamber 9 is such that the toner conveyed from the side of inlet 19 and the replenished toner will rise high at the outlet 20 within the agitating chamber 9. The agitating member 5 rotates repeatedly to level the toner horizontally, and then spreads it gradually throughout the agitating chamber 9, as indicated by arrows D. By repeating this operation the toner finally reaches the inlet 19 to pass through the opening, and drops into the developing chamber 10 with the aid of the gravitational force of the toner so as to be supplied to the toner supply roller 2.

The developing roller 1 and the toner supply roller 2 rotate in the directions as indicated by the arrows in FIG. 9. The developing roller 1 is coated with a toner due to rotational friction, and the toner is scraped to be leveled when it passes through a toner regulating member 3 abutting on the developing roller 1 as the developing roller 1 rotates, so that a thinned toner coat layer is formed on the developing roller 1. The toner that has not been expended by reason of low coverage rate is scraped off from the developing roller 1 by the toner supply roller 2, and subsequently conveyed by the screw 4, passing through the outlet 20 so as to be returned to the agitating chamber 9. Thus, a toner circulation in vertical direction is created, and the replenished toner and the existing toner are adequately agitated and conveyed.

Incidentally, in a developing apparatus of a replenishing system, a horizontal in-line system is commonly used, whereas a construction to circulate the toner in the gravitational direction, i.e. an up-and-down vertical direction would offer such an advantage that a width size of the entire developing apparatus can be reduced to achieve downsizing, which is very effective.

As illustrated in FIG. 10, the toner in the developing chamber 10 is conveyed by the screw 4 in a direction from the one side to the other side of the longitudinal direction, and fed by its conveying pressure C from the opening of the outlet 20 to the agitating chamber 9. Also, a toner replenished from the toner replenishing mechanism 8 is replenished to the side of the outlet 20 in the agitating chamber 9 in a similar way, since it takes an agitating time in the agitating chamber 9. The replenished toner is agitated and the surface 18 is leveled horizontally by the agitating member 5. The toner replenished by repeating this movement finally reaches the inlet 19 by the movement of spreading the toner over the agitating chamber 9 as indicated by the arrows D, and supplied from the inlet 19 into the developing chamber 10, as shown by arrow A.

On the other hand, when images with a high coverage rate are continuously printed, a difference in an image density likely occurs in the longitudinal direction of the developing apparatus, that is, in the toner conveying direction in which the toner is conveyed by the screw 4 of the developing apparatus in the direction indicated by arrow AC in FIG. 10, and as shown in a characteristic graph of FIG. 11 and in a density measuring point diagram of FIG. 12. This is because the presence ratio of the replenished toner in the agitating chamber 9 becomes more than that of the existing toner due to the continuous toner replenishing operation, as a result, the presence ratio of the replenished toner becomes high in the toner layer on the developing roller 1 in the vicinity of the inlet 19 of the developing chamber 10. In other words, in a circulation route having the inlet 19 and the outlet 20, the toner supplied from the inlet 19 is much coated on the developing roller 1 on the upstream side in the toner conveying direction.

Since the replenished toner has a high charge amount, the coat tends to be thin on the developing roller 1. On the contrary, since the existing toner has a low charge amount, the coat on the developing roller 1 tends to be thick. As a result, when a high portion and a low portion of the presence ratios of the replenished toner appear on the developing roller 1, the density becomes light at a high portion of the presence ratio of the replenished toner, whereas the density becomes dense at a low portion of the presence ratio of the replenished toner. This phenomenon noticeably occurs particularly under a high-temperature and high-humidity environment where difference in charge amount is likely to occur between the existing toner and the replenished toner.

Here, as illustrated in FIG. 13, if a cross-sectional area of a region of the developing chamber 10 surrounded by the developing container 12, excluding a conveying region of the screw 4, in a higher level region in the gravitational direction than the rotational axis of the supply roller 2 is expressed as S, the cross-sectional area S of the developing chamber 10 is constant at each point. It should be noted that the conveying region of the screw 4 is meant by a region covered by the uppermost point and the lowermost point of the screw shape.

Incidentally, there are common problems to be solved in the developing apparatus disclosed in Japanese Patent Application Laid-Open No. H11-024382 and the developing apparatus of the replenishing system as shown in FIG. 13.

Since the cross-sectional area S of the developing chamber 10 is constant at each point in the longitudinal direction, a force in a flow direction E caused by a toner blowoff is equal at each point in the longitudinal direction. Therefore, as illustrated schematically in FIG. 14, the flow of toner supplied from the inlet 19 as indicated by the arrows F is large on the upstream side in toner conveying direction, whereas the flow F of the toner supplied from the inlet 19 becomes gradually smaller toward the downstream side Even from this fact, the toner density has an impact on an unstable shading.

As described above, in whichever case where a toner is replenished under the impact of a cross-sectional construction of the developing chamber 10 and a high-temperature and high-humidity environment, and a print setting varies each time, it is strongly desired that a toner be coated uniformly on the developing roller 1, and the densities on the upstream side and downstream side in the toner conveying direction be uniformly maintained.

SUMMARY OF THE INVENTION

The present invention provides a developing apparatus that can secure a uniform density of a developer along a developer conveying direction of a developer conveying member corresponding to a longitudinal direction of a developer carrying member.

Also, the present invention provides a developing apparatus that can suppress the shading of density of the developer in a longitudinal direction of a developer carrying member.

Also, the present invention provides a developing apparatus that can perform adequately an agitation of the developer.

Also, the present invention provides a developing apparatus that has a varied developer conveying space through which the developer is conveyed toward a longitudinal direction of a developer carrying member in a developing chamber.

Further objectives and features of the present invention will become apparent from the following detailed description with reference to the attached drawings.

DESCRIPTION OF THE EMBODIMENTS

Figure 1:
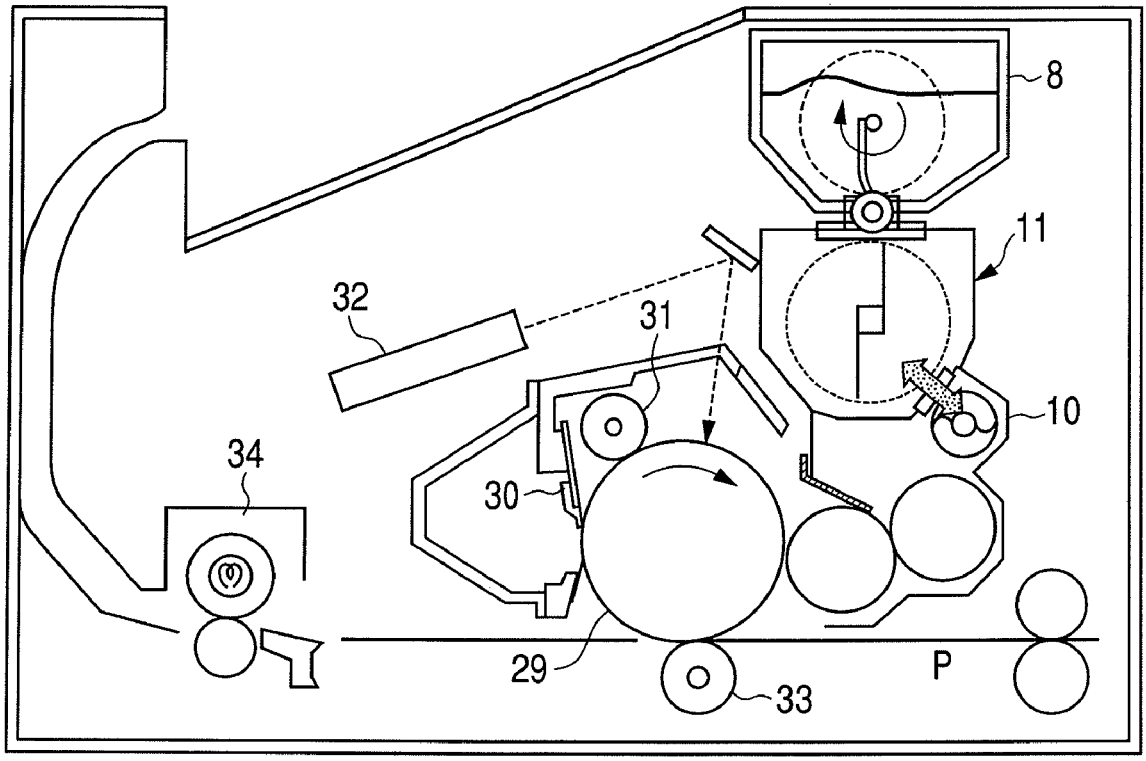
FIG. 1 is a general view illustrating one example of an image forming apparatus main body equipped with a developing apparatus according to an embodiment of the present invention.

Hereinafter, exemplary embodiments of a developing apparatus according to the present invention will be described in detail with reference to the drawings. FIG. 1 illustrates one example of an image forming apparatus equipped with a developing apparatus of the present embodiment.

(Image Forming Apparatus)

In a substantially central part of an image forming apparatus main body as illustrated in FIG. 1, for example, a drum-shaped electrophotographic photosensitive member 29 (hereinafter simply referred to as "photosensitive drum 29") as an image bearing member is supported rotatably in a clockwise direction as indicated by the arrow in FIG. 1. When an operation of an image formation begins, the surface of the photosensitive drum 29 is electrostatically charged uniformly by a charging member 31, a laser scanner 32 as a laser irradiating unit serving as an exposure unit performs exposure according to image information on the charged drum surface, then an electrostatic latent image is formed on the drum surface. The electrostatic latent image is visualized with a toner supplied to the photosensitive drum 29 by a developing apparatus 11, thus forming a toner image. As a toner, a negative chargeable non-magnetic mono-component developer is used. A transfer electric field is formed between the photosensitive drum 29 and a transfer roller 33 serving as a transfer unit, and then the toner image is electrostatically transferred by the transfer roller 33 on a sheet P serving as a recording medium.

An unfixed toner image on the sheet P is heated and pressed by a fixing device 34 to be permanently fixed on the sheet P. At this time, an untransferred toner residual on the surface of the photosensitive drum 29 that has finished transferring of the toner image will be removed by a cleaning device 30 provided with, for example, a blade-shaped cleaning member, and thus the photosensitive drum 29 resumes a state where it can subsequently perform image formation.

It should be noted that an image forming speed in the present embodiment, that is, a circumferential speed of the photosensitive drum 29 is 150 mm/sec, a circumferential speed of the developing roller 1 corresponding to that of the photosensitive drum 29 during a development is 225 mm/sec.

(Developing Apparatus)

Figure 2:
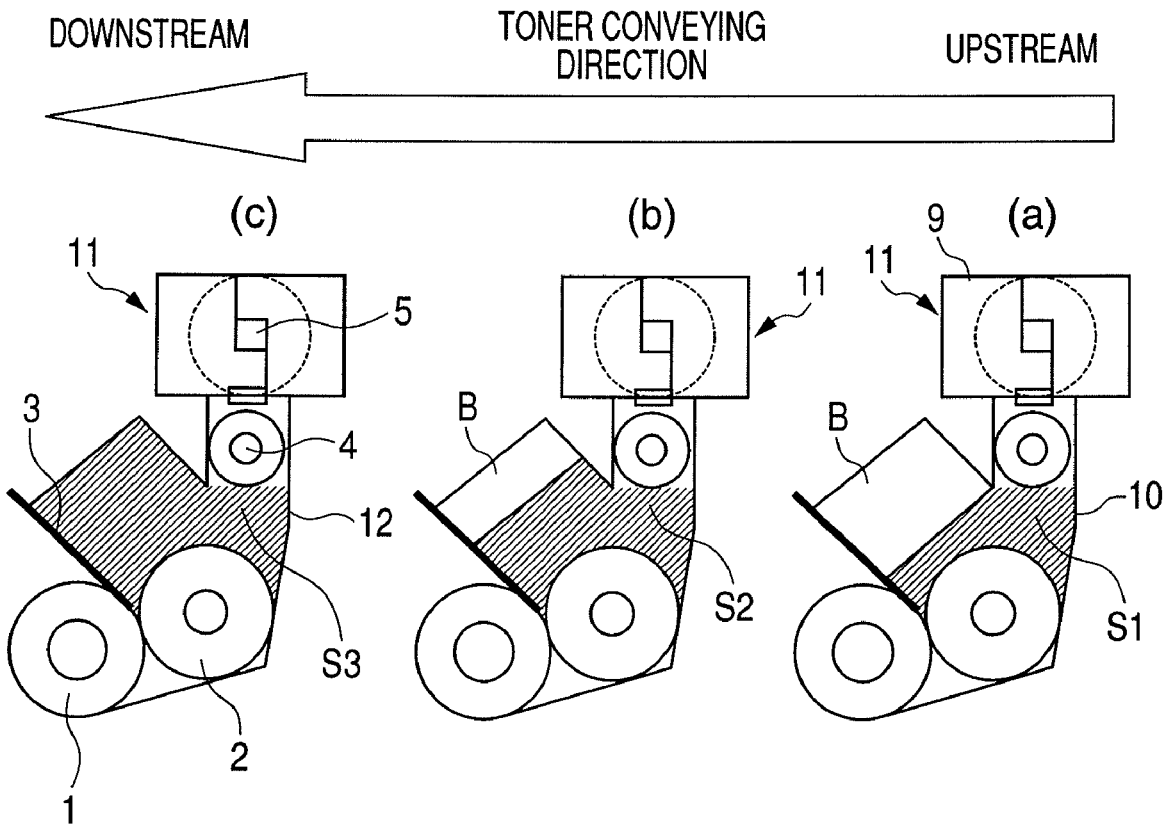
FIG. 2 is a set of cross-sectional views of a developing apparatus of the embodiment at several locations respectively along a toner conveying direction.

Next, FIG. 2 illustrates a developing apparatus equipped in the above-described image forming apparatus main body. It should be noted that the like reference numerals are utilized to designate the like members of the developing apparatus illustrated in FIG. 9 and FIG. 10 as a conventional example and descriptions of duplicate parts will be omitted, and members and mechanisms having the features as the present embodiment will be described with emphasis thereon.

A toner container (developing container) 12 provided in a developing apparatus 11 has an opening in one portion on one side facing the photosensitive drum 29, and a developing roller 1 serving as a developer carrying member is supported by a toner container rotatably in a direction indicated by an arrow so as to be partially exposed from the opening portion.

The developing roller 1 is a semi-conductive elastic member having an outside diameter of 20 mm, which is made of a foam or a rubber material such as silicone or urethane or a combination thereof having a low hardness and a volume resistivity of $10^2$ Ωcm to $10^{10}$ Ωcm with a conductive agent such as carbon being dispersed therein. The developing roller 1 abuts on a photosensitive drum 29 with a required abutting pressure.

Also, a supply roller 2 as a developer supplying member is provided in a developing chamber, and is an elastic roller formed with an elastic member or the like, and is positioned in a location where an insulating sponge roller having an outside diameter of 16 mm is caused to abut on the developing roller 1.

Also, the toner container 12 is provided with a blade (developer regulating member) 3 for regulating a toner layer thickness while abutting on the developing roller 1. This blade 3, which is made of SUS (stainless) and formed in a shape of a plate spring, abuts on the developing roller 1 under a required abutting pressure. A toner supplied on the developing roller 1 is regulated in its layer thickness by the blade 3, and imparted with an electric charge, thus forms a thin layer of the toner on the developing roller 1, and supplied to a developing region. Also, the toner that still remains on the developing roller 1 without contributing to development will be scraped off from the developing roller 1 due to the sliding friction caused by the supply roller 2. A part of scraped toner, together with a toner newly supplied onto the supply roller 2, will be supplied again onto the developing roller 1 by the supply roller 2, and the remaining toner will be returned into the toner container 12 to be collected. Thus, in the present embodiment, the supply roller 2 has two functions of a toner supplying function and a toner collecting function in combination. As illustrated also in FIG. 9, a rotating direction of the supply roller 2 is opposite to a rotating direction of the developing roller 1 at a contacting portion between the supply roller 2 and the developing roller 1.

Figure 9:
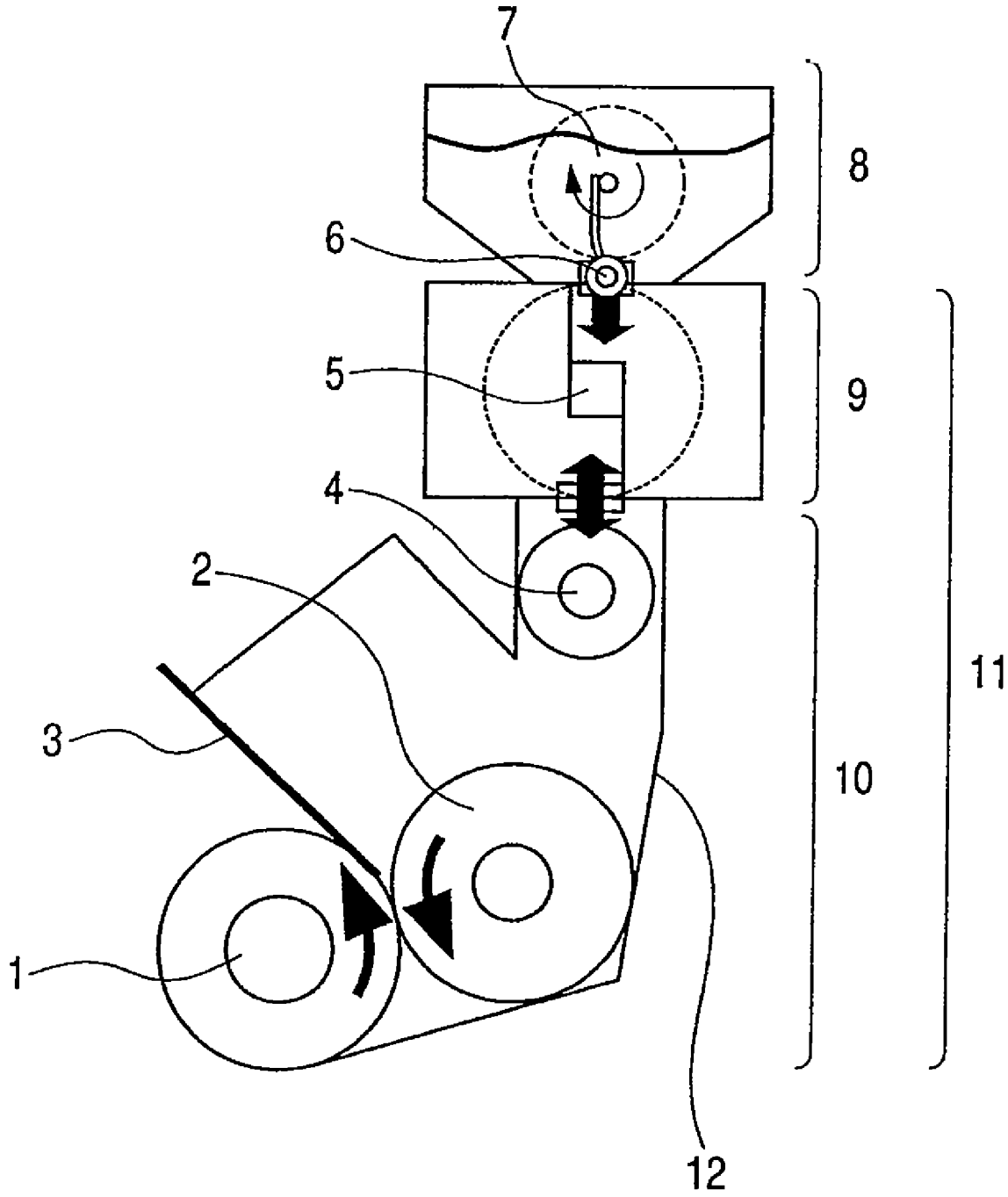
FIG. 9 is a view illustrating a circumferential section of a conventional developing apparatus of a toner vertical circulation system.

Next, within a toner hopper 8 serving as a toner replenishing mechanism, as illustrated in FIG. 9, an agitating member 7 for agitating a toner within the toner hopper 8 serving as a toner replenishing device, and a replenishing roller for replenishing a toner from the toner hopper 8 into the agitating chamber are arranged above a replenishing opening 6. Accordingly, when a replenishing command signal is issued from the developing apparatus, a toner of a predetermined amount per a unit period of a drive time is replenished into the agitating chamber, as indicated by the arrow 17 (refer to FIG. 10), and the toner replenishing mechanism operates such that an amount of toner within the toner container 12 is always kept at a predetermined amount. As a replenishing command system, there is available a system to detect presence or absence of toner by providing a piezoelectric sensor in the developing container 12, an optical detection system, an inductance detection system, and a system to calculate a consumed toner amount from a coverage rate of an image, and so on. For the present embodiment, a construction in which a toner amount sensor of the optical detection system is arranged in the agitating chamber to replenish a shortfall of toner from the replenishing mechanism is adopted. Since a toner amount sensor itself of the optical detection system has come into widespread use, it will not be especially shown herein. The replenishing opening 6, as illustrated in FIG. 10, is provided in the vicinity of one end in the longitudinal direction of the replenishing device.

Figure 10:
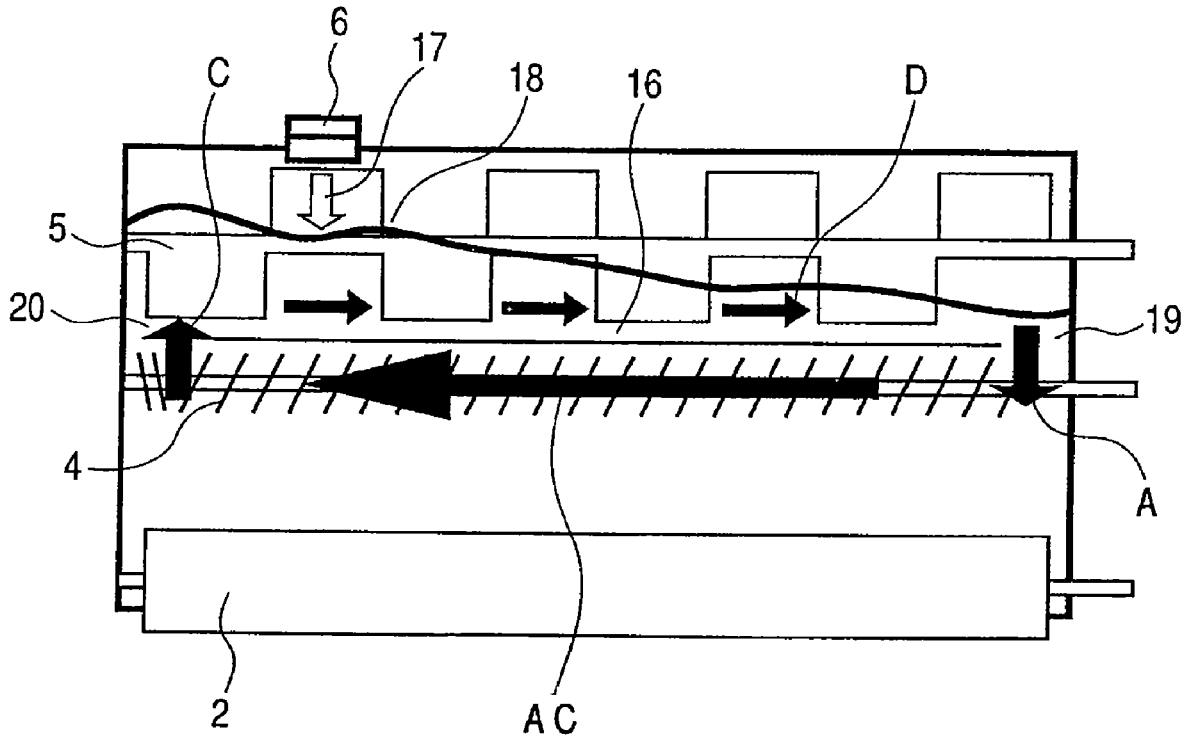
FIG. 10 is a view illustrating a longitudinal section of a conventional vertical circulation developing apparatus.
Figure 11:
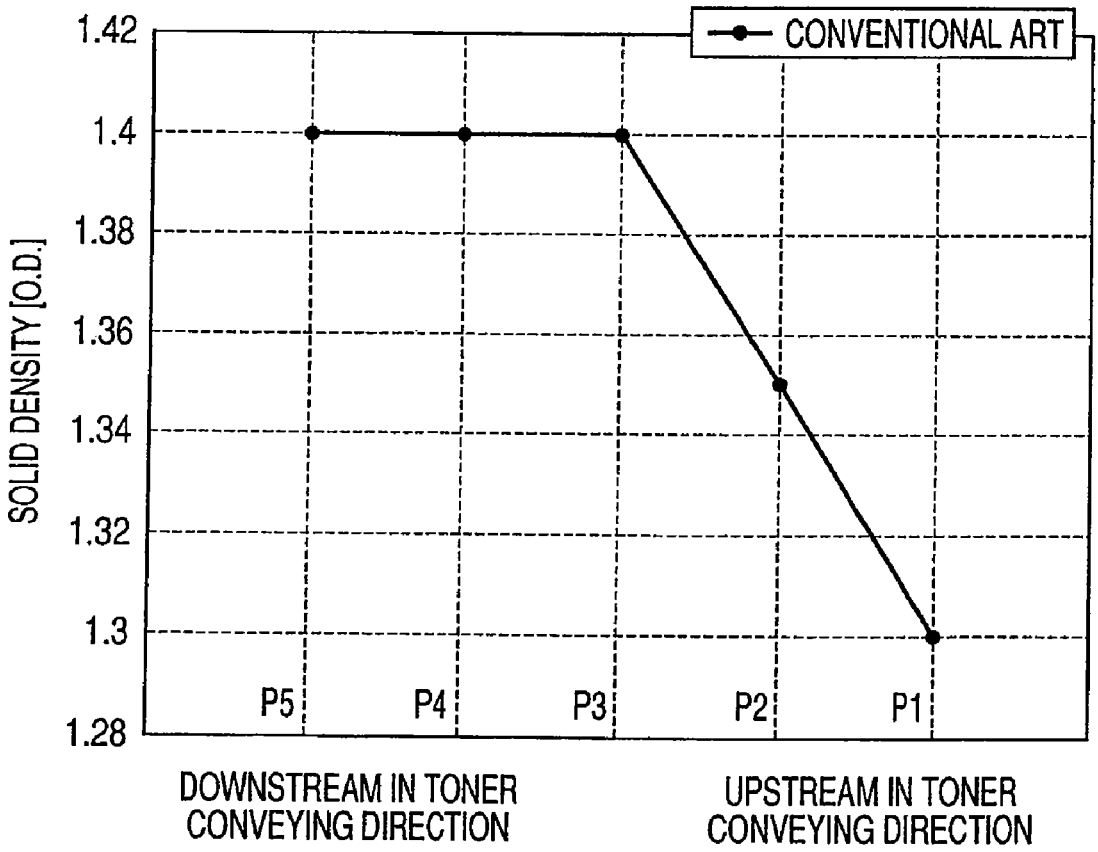
FIG. 11 is a solid density graph along the toner conveying direction under a high-temperature and high-humidity environment of a conventional example.
Figure 12:
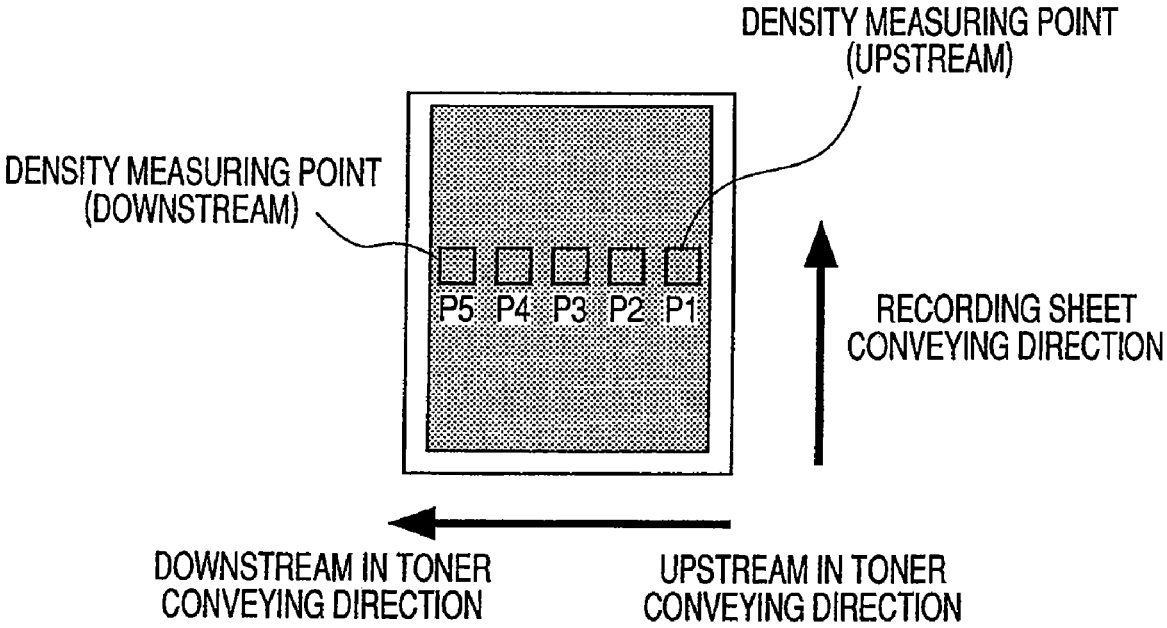
FIG. 12 is a view illustrating density measuring points in the conventional example.

On the other hand, as illustrated in FIG. 10, the developing apparatus 11 is separated into two upper and lower compartments by a partition wall 16, the lower one including the developing roller 1 carrying a toner and an agitating and push-feeding mechanism is referred to as a developing chamber 10, and the upper one having an agitating member 5 as an agitating chamber 9 (refer to FIG. 2). The developing chamber 10 and the agitating chamber 9 are communicated with each other via openings provided only at both ends. In the developing chamber 10 a screw (developer conveying member) 4 in a longitudinal direction is arranged, and plays the roles to: convey a toner within the developing chamber in the longitudinal direction; feed a toner that has dropped from the opening of the inlet 19 to a longitudinal central area of the developing chamber 10; and convey a toner in the developing chamber 10 up to the opening of the outlet 20 to feed it again to the agitating chamber 9 (refer to FIG. 10). The screw 4 is provided above the rotational center of the supply roller 2.

In the agitating chamber 9, the agitating member 5 having a plurality of blades is arranged, and the blades alternately stir a toner upward by their rotation thereby agitating the developer. The screw 4 and the agitating member 5 are connected by a gear (not shown) to the developing roller 1 and the supply roller 2, and configured to perform rotational motion together during an image formation, that is, while the developing roller 1 is rotating, and to stop rotating substantially in synchronism with the completion of the image formation. The developing chamber 10, as illustrated in FIG. 2, has difference in a cross-sectional shape between at an upstream side of a screw conveying direction and at a downstream side thereof, and the difference provides a difference in the volume of the developing chamber into which a toner is filled. As apparent from the cross-hatching portions shown in FIG. 2, a cross-sectional area of a region vertically above the rotational center of the supply roller 2, of the region surrounding by the developing chamber in a cross-section perpendicular to the longitudinal direction of the developing chamber, excluding the developer conveying region by the screw 4, is defined as S. The conveying region by the screw 4 means a region surrounded by the uppermost and lowermost points of the screw shape.

Figure 3:
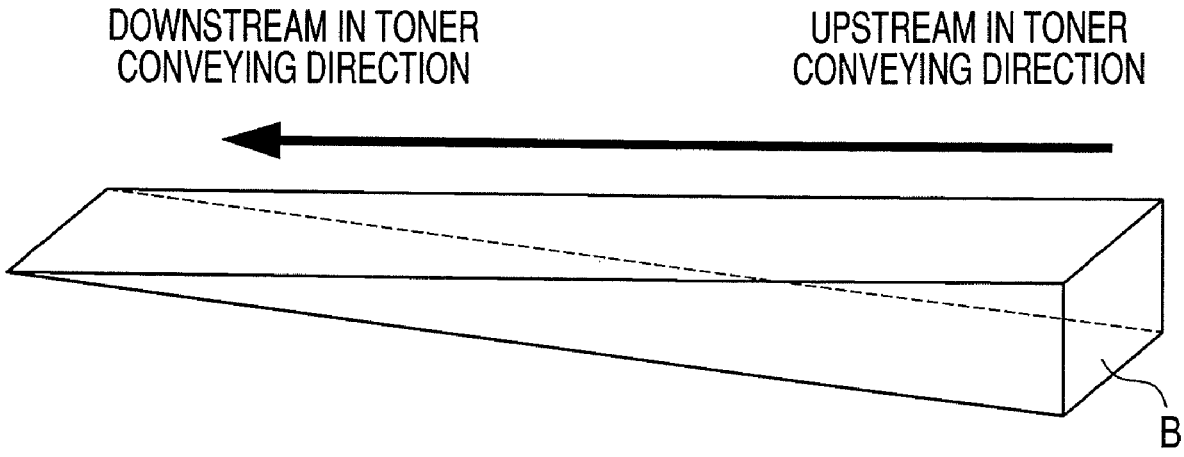
FIG. 3 is a perspective view illustrating a cross-sectional area variable member (volume-variable block) of a developing chamber of the present embodiment.

In consequence, as a construction that should be said to be a main point of the present embodiment, a cross-sectional area variable member (hereinafter simply referred to as "volume-variable block B") of the developing chamber by a wedge-shaped block portion as indicated by a reference sign B in FIG. 3 is simply provided to be embedded into the developing chamber 10, and allows to be also retrofitted to the developing chamber 10. In other words, in a conveying space formed in the longitudinal direction between the screw 4 serving as a developer conveying member and the supply roller 2 serving as a developer supplying member, a volume-variable block B allows to be retrofitted to change the volume from one side of upstream to the other side of downstream. This block B blocks a developer conveying passage (conveying space) in the developing chamber.

As illustrated in (a) of FIG. 2, in a starting point on the upstream side in the conveying direction by the screw, in the vicinity of the supply roller 2 and the toner container 12, the closest distance between the supply roller 2 and the volume-variable block B is set, for example, at 3 mm. Such the closest distance changes continuously toward downstream in the conveying direction, as illustrated in (b) of FIG. 2, the closest distance in the central area in the conveying direction is, for example, 5 mm. Also, as illustrated in (c) of FIG. 2, the closest distance at the end point on the downstream side, or the other side in the conveying direction is, for example, 7 mm. A block portion in a tapered shape that is gradually enlarging in this way with changing gradient angle is provided. Accordingly, when the wedge-shaped and tapered volume-variable block B is inserted into the developing chamber 10, cross-sectional areas S of a region surrounded by the developing chamber are changed to S1, S2, and S3. That is, the cross-sectional area S1 on the upstream side in the conveying direction, as indicated by the cross-hatching pattern in (a) of FIG. 2, is smaller than the cross-sectional area S2 on the downstream side in the conveying direction, as indicated by the cross-hatching pattern in (b) of FIG. 2, and meets a relationship of S1<S2. Further, S1 is smaller than the cross-sectional area S3 on the downstream side in the conveying direction, as indicated by the cross-hatching pattern in (c) of FIG. 2, and the cross-sectional area continuously changes from the cross-sectional area S1 to the cross-sectional area S3 so as to be S1<S2<S3, thus causing a volume within the developing chamber to be changed.

Figure 5:
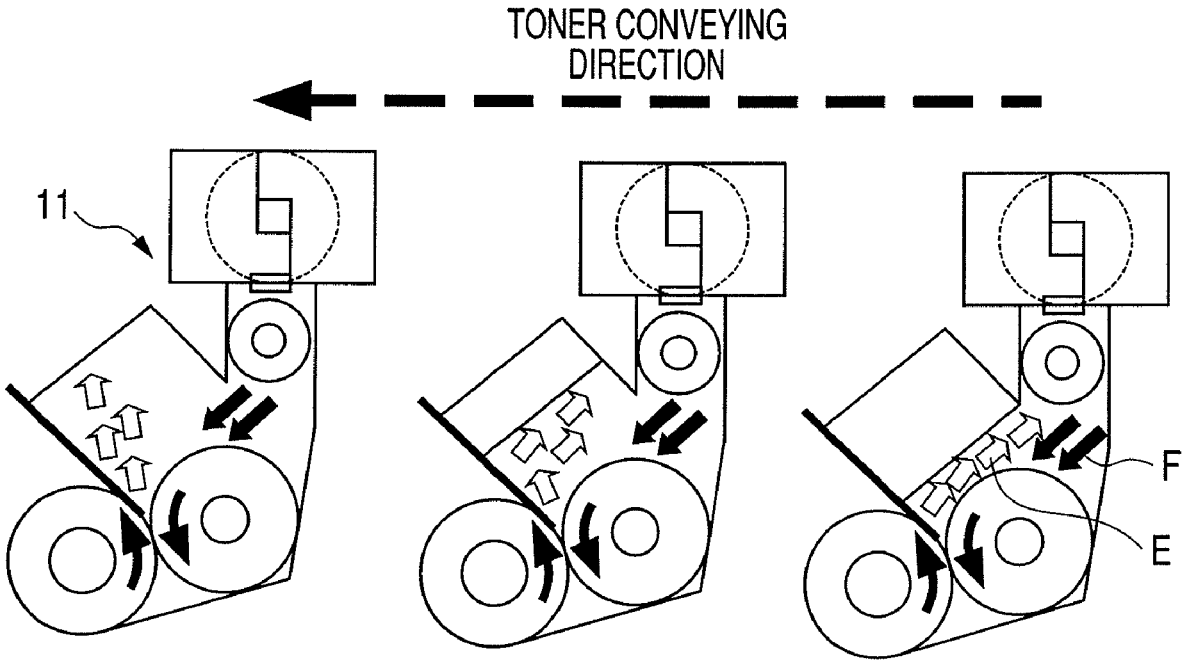
FIG. 5 is a view illustrating schematically a supply amount from the inlet in the present embodiment.

Therefore, the toner that has been supplied into the developing chamber 10 will be supplied to the supply roller 2, and then supplied to the developing roller 1 by subjecting the supply roller 2 and the developing roller 1 to a sliding friction. When the supply roller 2 is rubbed with the developing roller 1, a part of the toner contained in a sponge portion of the supply roller 2 that has not been applied to the developing roller 1, is blown off by the compression action and rotation action of the sponge from a nip portion where the supply roller 2 and the developing roller 1 abut against each other. Flows of the toner blown off from the supply roller 2 by continuously rotating the supply roller 2 occur in the upward directions E (white arrows) as illustrated in FIG. 5. Also, the toner turns from a static state to a dynamic state by the rotation of the supply roller 2. When the toner turns to the dynamic state, a flowability of the toner becomes high, thereby a bulk density of toner becomes low, that is, even a toner with the same weight requires the one with a larger volume, and thus a toner surface becomes high in the developing chamber 10. The toner reaches as high as the conveying region of the screw 4 resulting from the flow E blown off from the supply roller 2 and the rise of the toner surface due to the rotation of the supply roller 2 and thus the toner will be conveyed by the screw 4. The amount of conveyance of the screw 4 is determined mainly by the shape of the screw and the rotation speed of the screw.

Figure 13:
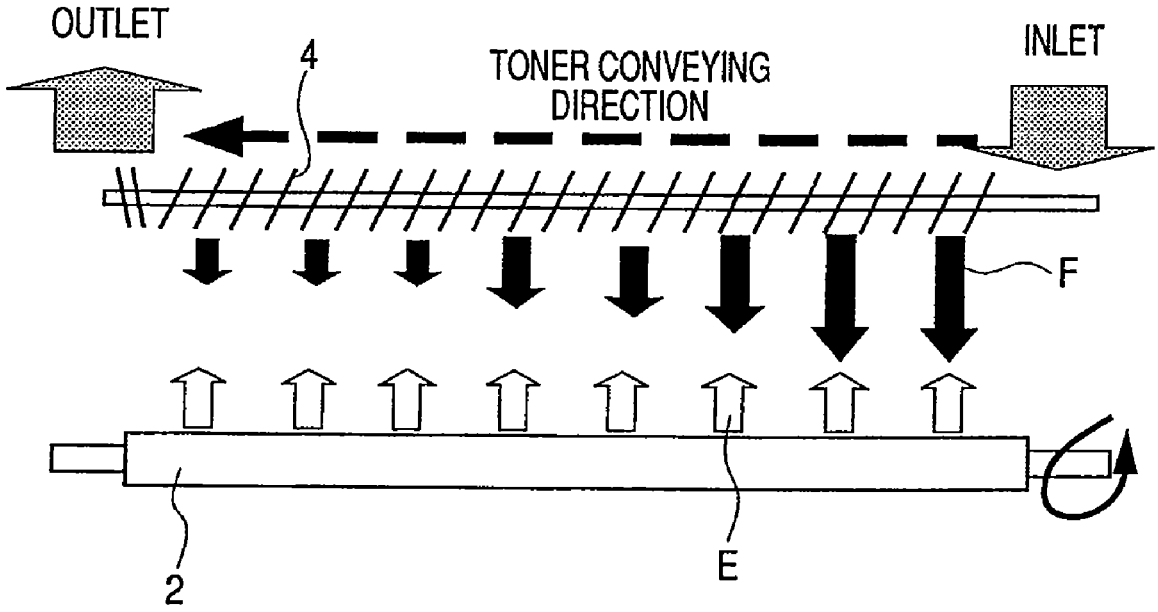
FIG. 13 is a view schematically illustrating a blow-off force from a supply roller of the conventional example.
Figure 14:
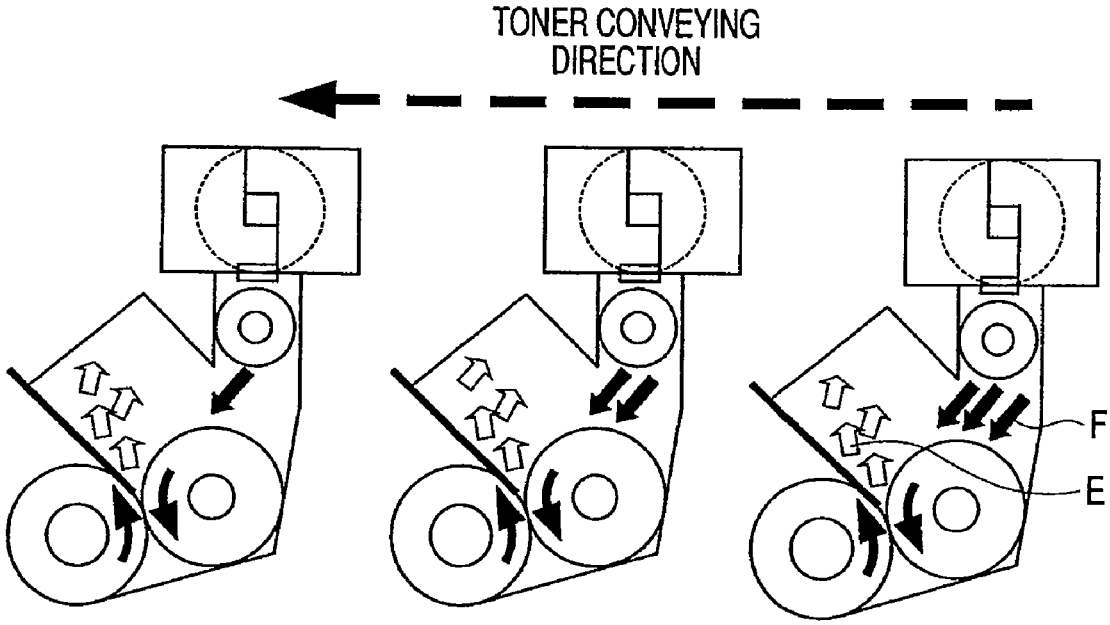
FIG. 14 is a view schematically illustrating a toner supply amount from an inlet of the conventional example.

Here, as illustrated in FIG. 13 and FIG. 14, if the cross-sectional area S of the conventional developing chamber is constant at each point in the longitudinal direction, a conveying force in the flow direction E caused by the toner blowoff remained the same at any points. For this reason, as in FIG. 13, the flows F (black arrows) of the toner supplied from the inlet 19 is larger at the upstream portion in the conveying direction, and the flows F of the toner supplied from the inlet 19 decrease gradually toward the downstream in the conveying direction.

Figure 4:
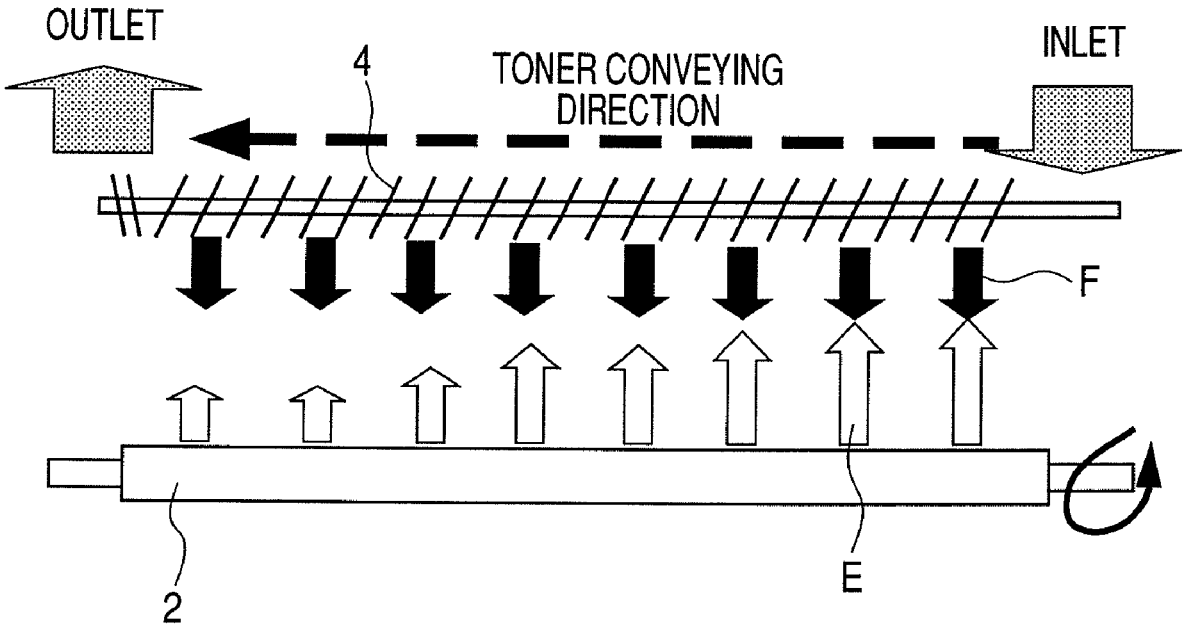
FIG. 4 is a view illustrating schematically a blow-off force from a supply roller along the toner conveying direction and a supply amount from an inlet in the present embodiment.

Contrary to the conventional art, according to the present embodiment, when the cross-sectional area S on the upstream side in the conveying direction is decreased, as indicated by the cross-hatching portion S1 in FIG. 2, the force in the direction E of the upward flow of the toner caused by the blowoff from the supply roller 2 can be increased as schematically illustrated in FIG. 4 and FIG. 5. Thereby, the flow F of the toner supply on the upstream side in the conveying direction can be alleviated, a frequency where the direction F of the toner supply is directed to the supply roller 2 can be reduced. Thereby, the presence ratio of the replenished toner can be suppressed on the upstream side in the conveying direction. Even if the toner supply is regulated to a certain degree in this way on the upstream side in the toner conveying direction, there are no cases where a shortage of the toner supply happens, since the toner supply inlet 19 from the agitating chamber 9 to the developing chamber 10 is close to a region where a sufficient toner supply can be effected.

Also, when the cross-sectional area S2 on the downstream side in the conveying direction is increased, the force in the directions E of the upward flow caused by the blowoff from the supply roller 2 becomes smaller compared with the one on the upstream side in the conveying direction, as illustrated in FIG. 4 and FIG. 5. For this reason, a frequency where the flows F of the toner supply are directed to the supply roller 2 increases so that a sufficient amount of toner can be supplied to the supply roller 2. Also, only if an attempt is made so that a sufficient volume is maintained on the downstream side, there are no cases where a toner packing due to the toner conveyance of the screw 4 will occur.

Thus, the flow F of toner supply can be decreased by increasing a magnitude of the flow E caused by the toner blowoff of the supply roller 2 on the upstream side in the conveying direction (refer to FIG. 4). Also, if a magnitude of the flow E caused by the toner blowoff of the supply roller 2 along a downstream side in the conveying direction is gradually decreased, the toner flow F can be increased, and thus the toner that has been supplied from the inlet 19 can be coated longitudinally uniformly onto the developing roller 1.

Figure 6:
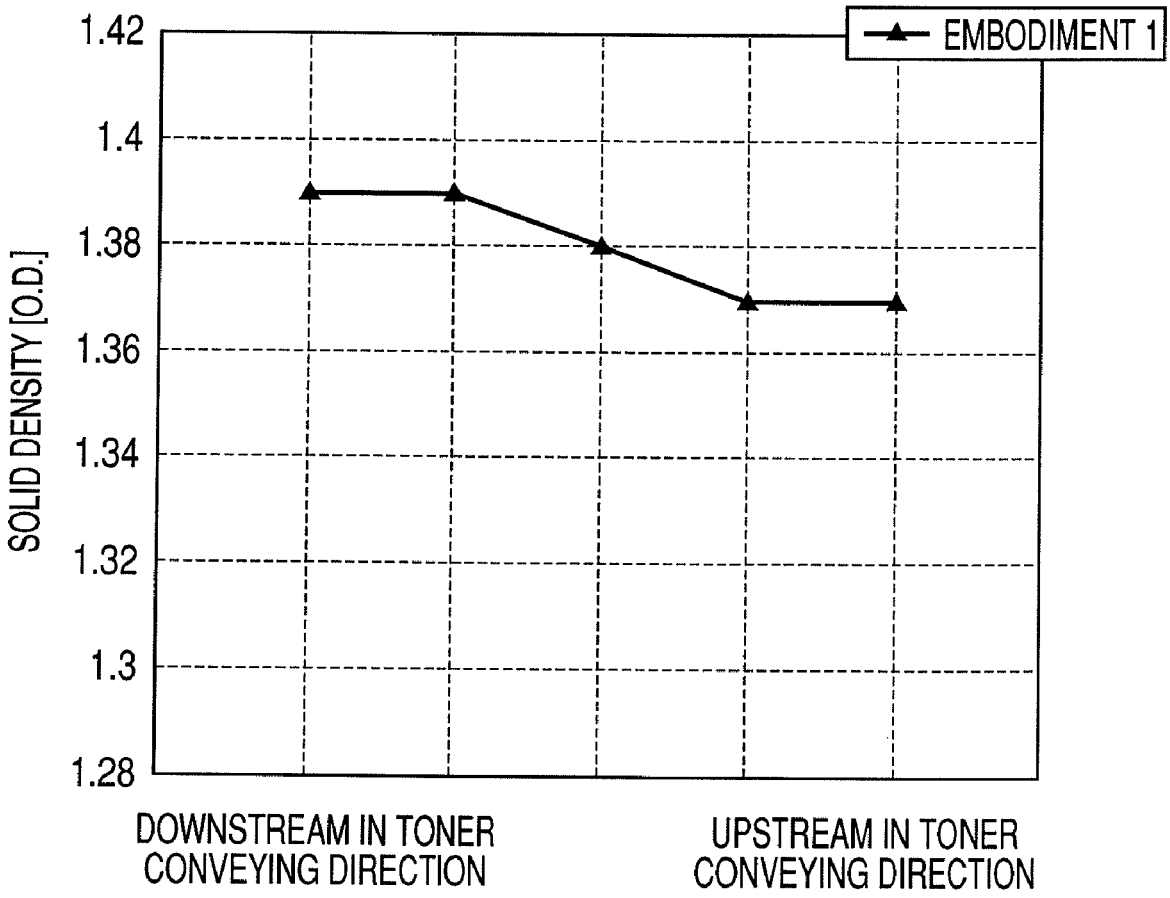
FIG. 6 is a graph illustrating a solid density along the toner conveying direction under a high-temperature and high-humidity environment in the present embodiment.

FIG. 6 shows a graph of density data of a solid black image measured by a Macbeth reflection densitometer. Under high-temperature and high-humidity (32° C., 85%) environment, a continuous printing durability was performed up to 25,000 sheets at a coverage rate of 1% using A4-sized sheets P, and thereafter images of a coverage rate of 40% were printed on 100 sheets in A4 size, and thereafter the solid black image was printed. According to this graph, it is possible to facilitate coating a supply toner longitudinally uniformly on the developing roller 1 by configuring the cross-sectional area S to be larger toward the downstream in the conveying direction. As a result, solid images with little density difference can be printed along the conveying direction.

As described above, the following effects are obtained according to the developing apparatus of the present embodiment.

If the cross-sectional area S (cross-hatching portions in FIG. 2) of the developer conveying region is enlarged along the conveying direction, the case where the toner supplied from the agitating chamber 9 is coated partially in large amount in the vicinity of the developing chamber inlet 19 will be eliminated. Also, the toner supplied from the inlet can be coated longitudinally uniformly over the whole area of the developing roller 1 by alleviating the toner supply along the conveying direction, and the occurrence of the uneven density can be avoided even in any environment or printing condition.

Figure 7A:
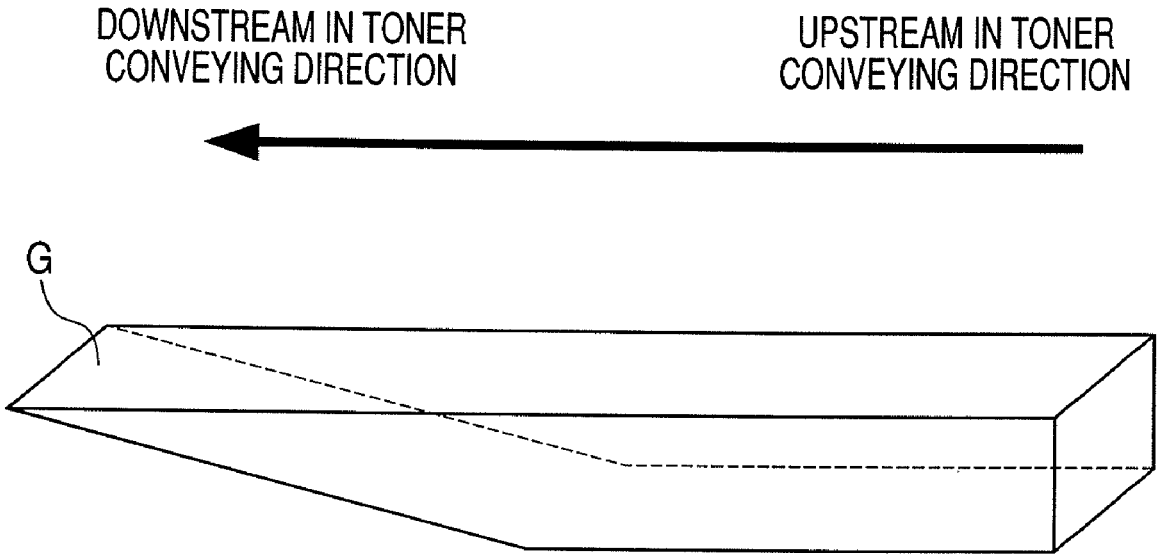
FIG. 7A and FIG. 7B are perspective views illustrating examples of variations of the above-mentioned volume-variable block.
Figure 7B:
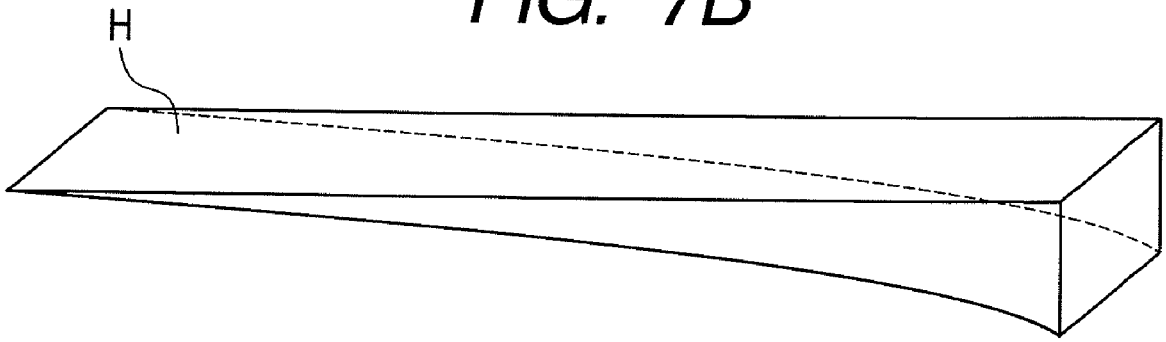

It is noted that, in this embodiment, an application example was shown using the wedge-shaped developing chamber embedded block portion B, as illustrated in FIG. 3. The block portion is not intended to limit to such a wedge-shaped one. FIG. 7A is a view illustrating a block portion G. The block portion G has a shape so that a developer conveying region has a small cross-sectional area S up to a central area in the conveying direction, and has a larger cross-sectional area S from the central area to the downstream side. Also, FIG. 7B is a view illustrating a block portion H. The block portion H may have an arc-shaped face opposed to the supply roller 2. In other words, it is important that the block portion H has a shape so that a cross-sectional area S in a developer conveying region becomes gradually wider in a tapered shape toward the downstream in the conveying direction.

(Process Cartridge)

Figure 8:
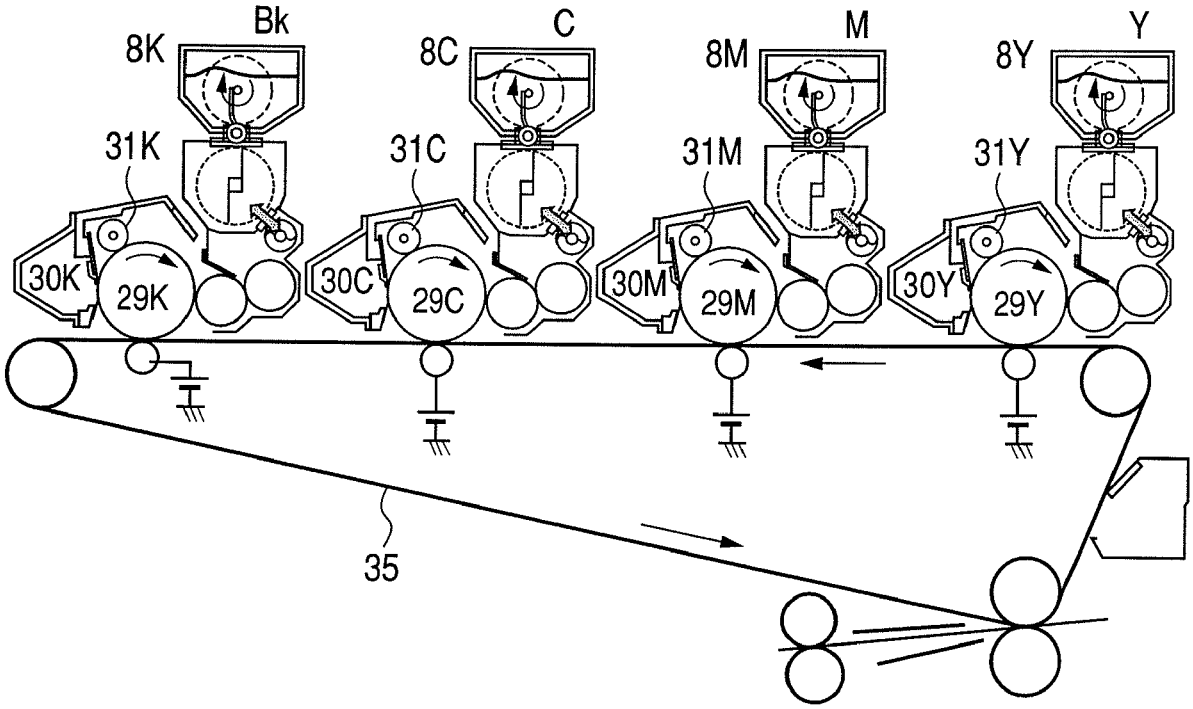
FIG. 8 is a general view illustrating a laser beam printer equipped with respective process cartridges of Y, M, C, and K each incorporating a developing apparatus of the present embodiment.

FIG. 8 illustrates a color laser printer as an image forming apparatus utilizing an electrophotographic process equipped with a developing apparatus of the present embodiment, and a configuration example of a main body of the printer on which a plurality of process cartridges are detachably mounted.

Developing apparatuses 11 corresponding to Y (yellow), M (magenta), C (cyan), and K (black), respectively of a full color each is constructed integrally with a photosensitive drum 29, a charge roller 31 and a cleaner unit 30 into a process cartridge, which is replaceable with respect to the image forming apparatus main body when the process cartridge reaches the end of its durability life. Four process cartridges containing the above-described four-color toners, i.e. Y, M, C, and K are detachably mounted in the image forming apparatus main body. Also, toner hoppers 8 adapted for Y, M, C, and K in the similar way to the first embodiment are detachably mountable to the image forming apparatus main body. Since the configuration and operation of a photosensitive drum, a developing roller, and a charge roller each constituting a process unit, contained in the process cartridge, are the same as those of the first embodiment, and thus duplicate descriptions will not be made.

A toner image formed on the surface of the photosensitive drum 29 will be multiple-formed onto an intermediate transferring member 35 in the shape of an endless belt in the order that respective process cartridges for Y, M, C, and K are arranged, then transferred onto a transferring material conveyed by a sheet feed roller, subsequently heated and press-fixed by a fixing device (not shown) and finally discharged as a full color image.

In such a full-color image formation, since multiple-color images are superimposed on a sheet of paper, far higher level is required for uneven density or fog than in a monochromatic printing machine. Regarding this point, a toner circulation of the present embodiment can be also used more favorably for a full-color image forming apparatus.

Also, the adoption of easily detachable cartridge system for these components facilitates replacing them as consumable components, and thus the maintainability of the image forming apparatus is also exceptionally improved. Also, since major components of electrophotography are replaced with the new ones by replacing the cartridges, high quality images can be kept all the times. The cartridges are not limited to the process cartridges, but also a developing cartridge, which is a cartridge into which a developing apparatus is incorporated.

It is noted that, a developing apparatus of the present invention is not limited to the aforementioned embodiments, but also the structure of a process cartridge as shown is strictly for the purpose of one example, and other embodiments, application examples, variations and the combination thereof are feasible only if they are within the scope that does not depart from the spirit of the present invention.

According to a developing apparatus of the present invention, a cross-sectional area S2 on the downstream side in a conveying direction of a developer caused by a developer conveying member can be configured to be larger than a cross-sectional area S1 on the upstream side in the conveying direction, and the developer can be uniformly coated and carried on the surface of the developer carrying member. As a result, an uneven density of the developer can be avoided, and a stable toner circulation can be produced.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2006-334447, filed Dec. 12, 2006, which is hereby incorporated by reference herein in its entirety.

What is claimed is:

1. A developing apparatus comprising:

an agitating chamber agitating a developer;

a developing chamber provided with an inlet to which the developer is supplied from the agitating chamber, and an outlet from which the developer is returned to the agitating chamber;

a developer carrying member carrying the developer to develop an electrostatic image formed on an image bearing member with the developer;

a rotatable developer supplying member, provided in the developing chamber, for supplying the developer to the developer carrying member; and a developer conveying member, provided above a center of rotation of the developer supplying member in the developing chamber, for conveying the developer in a longitudinal direction of the developer carrying member, wherein, in a cross-sectional area of a region vertically above the center of rotation of the developer supplying member of a region surrounded by the developing chamber in a cross-section perpendicular to a longitudinal direction of the developing chamber, excluding a developer conveying region by the developer conveying member, a cross-sectional area S1 upstream in a developer conveying direction by the developer conveying member and a cross-sectional area S2 downstream in the developer conveying direction by the developer conveying member satisfy a relationship of S1<S2.

2. A developing apparatus according to claim 1, further comprising a block portion blocking a conveyance passage of the developer in the developing chamber to satisfy the relationship of S1<S2.

3. A developing apparatus according to claim 1, wherein the cross-sectional area of the region gradually increases from upstream in the developer conveying direction by the developer conveying member toward downstream in the developer conveying direction.

4. A developing apparatus according to claim 3, further comprising a block portion blocking a conveyance passage of the developer in the developing chamber, so that the cross-sectional area of the region gradually increases from upstream in the developer conveying direction by the developer conveying member toward downstream in the developer conveying direction.

5. A developing apparatus according to claim 4, wherein the block portion is a separate member from a developing container forming the developing chamber.

6. A developing apparatus according to claim 1, further comprising a developer regulating member abutting on a surface of the developer carrying member for regulating the developer, the developer regulating member being provided in the developing chamber.

7. A developing apparatus according to claim 1, wherein the developer conveying member conveys the developer supplied from the inlet to the outlet.

8. A developing apparatus according to claim 1, wherein the developer conveying member is provided so as to return the developer from the developing chamber to the agitating chamber through the outlet.

9. A developing apparatus according to claim 1, wherein the developer conveying member is a screw.

10. A developing apparatus according to claim 1, wherein the agitating chamber is provided above the developing chamber.

11. A developing apparatus according to claim 1, wherein the developer supplying member is provided in contact with the developer carrying member.

12. A developing apparatus according to claim 1, wherein a developer is replenished by a developer replenishing device into the agitating chamber.

13. A developing apparatus according to claim 1, wherein the developer carrying member is provided in the developing chamber.

14. A developing apparatus according to claim 1, wherein the developing apparatus is detachably provided in a main body of an image forming apparatus.

15. A developing apparatus according to claim 1, wherein the developing apparatus is detachably provided in a main body of an image forming apparatus together with the image bearing member.

* * * * *